US011073326B2

(12) United States Patent
Raab et al.

(10) Patent No.: US 11,073,326 B2
(45) Date of Patent: Jul. 27, 2021

(54) DOOR COMPRISING A DOOR FRAME AND A RECESSED HANDLE ELEMENT, AND A DOMESTIC REFRIGERATION APPLIANCE COMPRISING SUCH A DOOR

(71) Applicant: BSH HAUSGERAETE GMBH, Munich (DE)

(72) Inventors: Alfred Raab, Huettlingen (DE); Friedrich Klein, Bachhagel (DE); Tobias Heisswolf, Syrgenstein (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/766,062

(22) PCT Filed: Oct. 12, 2016

(86) PCT No.: PCT/EP2016/074466
§ 371 (c)(1),
(2) Date: Apr. 5, 2018

(87) PCT Pub. No.: WO2017/076594
PCT Pub. Date: May 11, 2017

(65) Prior Publication Data

US 2018/0283768 A1 Oct. 4, 2018

(30) Foreign Application Priority Data

Nov. 6, 2015 (DE) ..... 10 2015 221 885.6

(51) Int. Cl.
*F25D 23/02* (2006.01)
*F24C 15/02* (2006.01)
*E05B 1/00* (2006.01)

(52) U.S. Cl.
CPC ..... *F25D 23/028* (2013.01); *E05B 1/0015* (2013.01); *F24C 15/024* (2013.01)

(58) Field of Classification Search
CPC ..... F25D 23/028; F24C 15/024; E05B 1/0015
(Continued)

(56) References Cited

U.S. PATENT DOCUMENTS 3,024,880 A * 3/1962 Burmeister ..... E04C 2/543 52/311.3
3,228,388 A * 1/1966 Mills ..... F24C 15/04 126/200

(Continued)

FOREIGN PATENT DOCUMENTS

CN 1530605 A 9/2004
CN 201983579 U 9/2011

(Continued)

*Primary Examiner* — Daniel J Troy
*Assistant Examiner* — Timothy M Ayres
(74) *Attorney, Agent, or Firm* — Laurence A. Greenberg; Werner H. Stemer; Ralph E. Locher

(57) ABSTRACT

A door for a domestic refrigeration appliance has a door inner panel and a door outer panel. The inner and outer panels are arranged on a single-piece, multiple-sided door frame. The door frame is open in the peripheral direction of the frame shape, and a separate recessed handle element is arranged in an open peripheral section of the door frame. There is also described a domestic refrigeration appliance with a door.

12 Claims, 4 Drawing Sheets

(58) Field of Classification Search
USPC ..... 312/405
See application file for complete search history.

(56) References Cited

U.S. PATENT DOCUMENTS 3,773,399 A * 11/1973 Sulcek ..... A47B 96/201 312/204
3,834,101 A * 9/1974 Wilder ..... E06B 3/78 428/122
5,029,571 A * 7/1991 Trosin ..... F24C 15/04 126/200
5,048,233 A * 9/1991 Gidseg ..... E06B 3/78 126/198
5,520,453 A * 5/1996 Aoki ..... E06B 3/7001 312/234
5,819,722 A * 10/1998 Katz ..... F24C 15/006 126/200
7,014,281 B2 * 3/2006 Wuestefeld ..... A47L 15/4265 126/194
7,043,886 B1 * 5/2006 Chubb ..... A47F 3/0434 312/138.1
7,665,810 B2 * 2/2010 Crompton ..... F25D 23/10 312/204
8,104,853 B2 * 1/2012 Kim ..... F25D 23/02 312/401
8,142,038 B2 * 3/2012 Li ..... F21V 33/0044 362/125
8,328,301 B2 † 12/2012 Lee
8,336,974 B2 * 12/2012 Lee ..... F25D 23/028 312/204
8,485,617 B2 * 7/2013 Park ..... F25D 23/028 312/405.1
8,567,885 B2 10/2013 Lee et al.
8,714,672 B2 * 5/2014 Heckler ..... F25D 23/02 312/326
8,752,921 B2 * 6/2014 Gorz ..... F25D 23/062 312/406.2
9,310,123 B2 * 4/2016 Guarino ..... F25D 23/02
9,459,041 B2 10/2016 Park et al.
9,500,402 B2 * 11/2016 Kim ..... F25D 23/02
10,018,218 B2 * 7/2018 Jung ..... F25D 23/028
10,145,603 B2 * 12/2018 Kim ..... F25D 23/02
2005/0194874 A1 * 9/2005 Jang ..... E05D 5/065 312/405
2005/0225221 A1 * 10/2005 Song ..... F25D 23/02 312/401
2008/0036349 A1 * 2/2008 Crompton ..... F25D 23/062 312/401
2011/0273071 A1 * 11/2011 Kim ..... F25D 23/028 312/405
2012/0038258 A1 * 2/2012 Park ..... E05D 7/0027 312/405
2013/0099650 A1 * 4/2013 Lee ..... F25D 23/028 312/404
2016/0138853 A1 * 5/2016 Kim ..... F25D 23/028 312/405
2016/0334158 A1 * 11/2016 Joo ..... F25C 5/22
2017/0115049 A1 * 4/2017 Ding ..... F25D 23/028

FOREIGN PATENT DOCUMENTS

CN 102235784 A 11/2011
CN 102374733 A 3/2012
CN 102620503 A 8/2012
CN 104296475 A 1/2015
CN 104344658 A 2/2015
CN 104748491 A 7/2015
CN 104956170 A 9/2015
DE 102009028786 A1 2/2011
DE 102012223547 A1 6/2014
EP 2184571 A2 5/2010
WO 2012126703 A2 † 9/2012

* cited by examiner
† cited by third party

DOOR COMPRISING A DOOR FRAME AND A RECESSED HANDLE ELEMENT, AND A DOMESTIC REFRIGERATION APPLIANCE COMPRISING SUCH A DOOR

BACKGROUND OF THE INVENTION

Field of the Invention

The invention relates to a door for a domestic refrigeration appliance, with a door inner panel and a door outer panel, which are arranged on a resulting multiple-sided door frame.

Such a door configuration is known for example from DE 1 977 437 U. In this the door frame is closed all the way round and the door panels are fastened thereto.

Many other different configurations of doors for domestic refrigeration appliances are known. As they also have many different components for the purpose of a thermal insulation effect due to their configuration, there are a large number of variants, which have to be produced using different components.

Such components can be arranged or configured on such a door in many different ways specifically in respect of their arrangement with a handle. For structural reasons, it is therefore necessary with many doors to select a handle position which does not impair the thermal insulation effect so the handle is often positioned on the outside. This enlarges the structure of the door specifically in the depthwise direction and therefore in respect of thickness.

SUMMARY OF THE INVENTION

It is the object of the present invention to create a door for a domestic refrigeration appliance and such a domestic refrigeration appliance, in which the structure of the door is compact and the thermal insulation effect is maintained.

This object is achieved by a door and domestic refrigeration appliance according to the independent claims.

An inventive door for a domestic refrigeration appliance comprises a door inner panel and a door outer panel that is separate therefrom. The door inner panel and door outer panel are arranged at a distance from one another. The door also comprises a door frame that is separate from the door inner panel and door outer panel. This door frame is produced in particular by bending and is configured with multiple sides. This means that it extends to multiple sides of a rectangular door when said door is configured with rectangular geometry. The door frame therefore forms a component of the door arranged on the narrow side formed in the depthwise direction between the door inner panel and the door outer panel.

One important concept of the invention is that the door frame is open in the peripheral direction of the frame shape. A recessed handle element, which is separate from the door frame, is arranged on an open peripheral section of the door frame then formed in this peripheral direction. Such a configuration means that the structure of the door can be very compact, particularly in the depthwise direction. A handle, configured in particular specifically as a recessed handle, is configured, in particular integrated, in this recessed handle element. As this recessed handle element itself is in turn arranged in a specific location, specifically on this narrow side wall of the door and also in a precise location in this open peripheral section, the structure is also very compact in the widthwise direction of the door. This recessed handle element also provides a manner of lateral end part, which completes the door frame in respect of outward concealment of a space between the door inner panel and the door outer panel.

Provision is preferably made for the recessed handle element to be connected to the door frame at opposing ends when viewed in the peripheral direction of the frame shape. This results in a mechanically stable structure and the door frame in conjunction with the recessed handle element then forms a manner of entirely closed composite component when viewed in the peripheral direction. The recessed handle element is also then held in position and even the door frame, which is not closed in the peripheral direction, is stabilized.

Provision is preferably made for the recessed handle element to be bonded or welded to the door frame. Such a non-destructively permanent connection is simple to produce and is functionally reliable in the long term.

Provision can also be made for the recessed handle element to be screwed to the door frame or to be connected by way of a plug-type connection, which can also be a latching connection. Such a configuration of a non-destructively detachable connection can also be assembled quickly while still allowing a high level of mechanical stability.

Provision is preferably made for the recessed handle element to be configured as trough-shaped. This allows very easy engagement therein and the entire recessed handle element per se is then also very rigid, in particular torsionally rigid.

Provision is preferably made for the recessed handle element to be configured as a single piece. This reduces the number of components and improves mechanical stability. Assembly outlay is also reduced as a result.

Provision can be made for the recessed handle element to be made of metal. Provision can also be made for the recessed handle element to be an injection-molded part.

In a further advantageous embodiment the door frame is configured with, in particular only, three sides and the recessed handle element extends over the entire width of the open peripheral section when viewed in the peripheral direction. In particular the width corresponds to a side part of the door frame opposite the peripheral section. With such a configuration the recessed handle element is then configured with dimensions, when viewed in the peripheral direction, which correspond to this opposite side part. The recessed handle element then thus forms a manner of further entire side part of a frame shape that is closed along four sides.

In one advantageous embodiment provision is made for the recessed handle element, when viewed in the depthwise direction of the door, to have dimensions which correspond to the adjoining side parts of the door frame. This means that the recessed handle element does not project beyond it in the depthwise direction and is also not smaller than it. The door frame and recessed handle element therefore have a uniform depth all the way round, thereby allowing very favorable positioning of the door inner panel and the door outer panel. A very close arrangement is then produced with the result that a thermal insulation material cannot be introduced into the space delimited by the door inner panel and the door outer panel and the support frame and the recessed handle element.

Provision is preferably made for the door frame to be configured with four sides and for the recessed handle element to extend over the entire width of the open peripheral section when viewed in the peripheral direction, said width being smaller than a width of a side part of the door frame opposite the peripheral section. With this configuration the door frame is thus configured with a side part which is shorter than the side part opposite said side at least on one side. This means that when there is a relatively long opposing side part, the recessed handle element can be shorter and therefore lighter in weight per se.

In a further advantageous embodiment provision is made for the open peripheral section to be configured at the top. The recessed handle element is then arranged in the peripheral section as a top door end strip. There is then no longer any need for an additional separate door end strip in this top region. This recessed handle element is then configured as multi-functional here at least too.

Provision is preferably made in a further embodiment for the open peripheral section to be configured in a vertical side of the door and for the recessed handle element to be arranged in the peripheral section as a lateral door end strip. Provision is made in particular with such a configuration for the recessed handle element then not to be configured over the entire extension of this vertical side when viewed in the peripheral direction so that with this embodiment the door frame is configured in particular with four sides.

In contrast with the configuration of the recessed handle element as a top door end strip provision is preferably made for the support frame only to be configured with three sides and for the recessed handle element to extend, when viewed in the peripheral direction of the frame shape, over dimensions which correspond to the opposing side part of the support frame.

In a further advantageous embodiment provision is made for side parts of the door frame to be configured as U-shaped in their respective cross-section. This significantly improves mechanical stability and in particular torsional rigidity.

Such configurations also form advantageous connecting points and mechanically stable supports for the door inner panel and door outer panel.

Provision is preferably made here for the door outer panel to be arranged on the inside on U-arms of the tabs of the side parts forming a U-shape and/or for the door inner panel to be arranged on the inside on U-arms of the tabs of the side parts forming a U-shape. This configuration allows very precise location of the door inner panel and door outer panel on the support frame. It also means that the space delimited by the door inner panel and the door outer panel as well as the door frame and the recessed handle element is not restricted. Also the panels cannot drop out of the space.

Provision is preferably made for a thermally insulating material, in particular an insulating foam, to be arranged or positioned in a space configured between the door outer panel and the door inner panel.

A decorative panel, which is separate from the door outer panel, is preferably arranged on the outside of the door outer panel facing away from the door frame. In particular the surface dimensions of the decorative panel are such that it completely conceals the door outer panel.

Provision can be made for the door inner panel and/or door outer panel to be bonded to the abovementioned tabs of the door frame.

The invention also relates to a domestic refrigeration appliance for holding food, which has a housing in which a chamber for holding food is configured. The domestic refrigeration appliance also comprises a door according to the invention or an advantageous configuration thereof. The door is configured to close the chamber and is arranged on the housing, in particular in a pivotable manner.

The door frame is preferably a bent profile or an extruded profile or a rolled profile in a single-piece configuration.

The terms "top", "bottom", "front", "rear", "horizontal", "vertical", "depthwise direction", "widthwise direction", "heightwise direction" indicate the positions and orientations defined when the appliance is used and arranged in the correct manner and for an observer standing in front of the appliance and looking in the direction of the appliance.

Further features of the invention will emerge from the claims, the figures and the description of the figures. The features and feature combinations cited above in the description and the features and feature combinations cited below in the description of the figures and/or shown in the figures alone can be used not only in the respectively cited combination but also in other combinations, without departing from the scope of the invention. Thus embodiments of the invention, which are not specifically shown and explained in the figures but emerge and can be generated from the embodiments described by means of separate feature combinations, should also be considered to be included and disclosed. Embodiments and feature combinations, which therefore do not comprise all the features of an originally formulated independent claim, should also be considered to be disclosed. Additionally embodiments and feature combinations, which go beyond or deviate from the feature combinations set out in the claim references, should be considered to be disclosed, in particular by the embodiments set out above.

BRIEF DESCRIPTION OF THE SEVERAL VIEWS OF THE DRAWING

Exemplary embodiments of the invention are described in more detail below based on schematic drawings, in which.

Identical elements or those of identical function are shown with identical reference characters in the figures.

DESCRIPTION OF THE INVENTION

Figure 1:
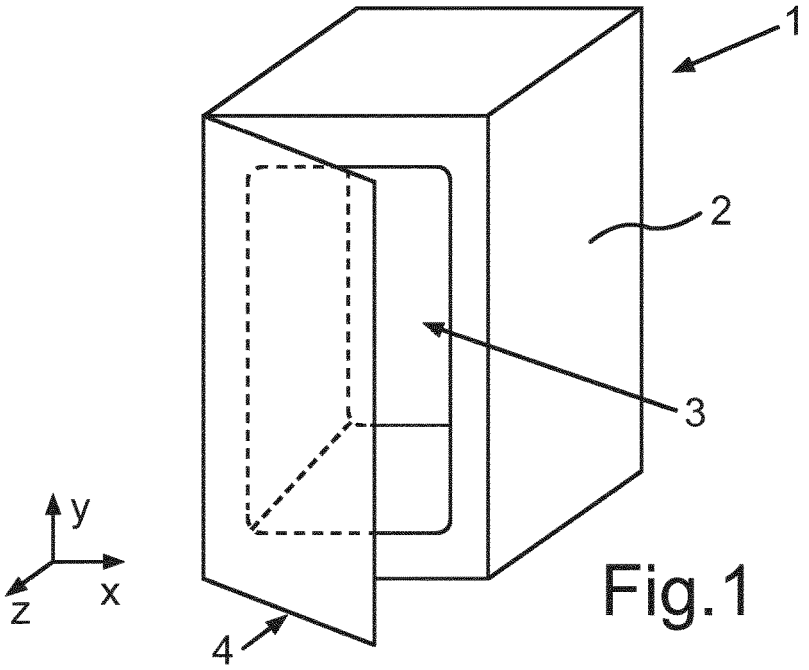
FIG. 1 shows a perspective view of an exemplary embodiment of an inventive domestic refrigeration appliance.

FIG. 1 shows a perspective view of a domestic refrigeration appliance 1, which can be for example a refrigerator or a freezer or a combined refrigerator/freezer appliance. The domestic refrigeration appliance 1 is configured to hold food and comprises a housing 2. Configured in the housing 2 is a chamber 3 for storing and conserving food, such as foodstuffs and beverages. The chamber 3 is delimited by walls of an inner container, which is arranged in the housing 2. The domestic refrigeration appliance 1 also comprises a door 4, which is arranged in a pivotable manner on the housing 2 and is configured to close the chamber 3.

Figure 2A:
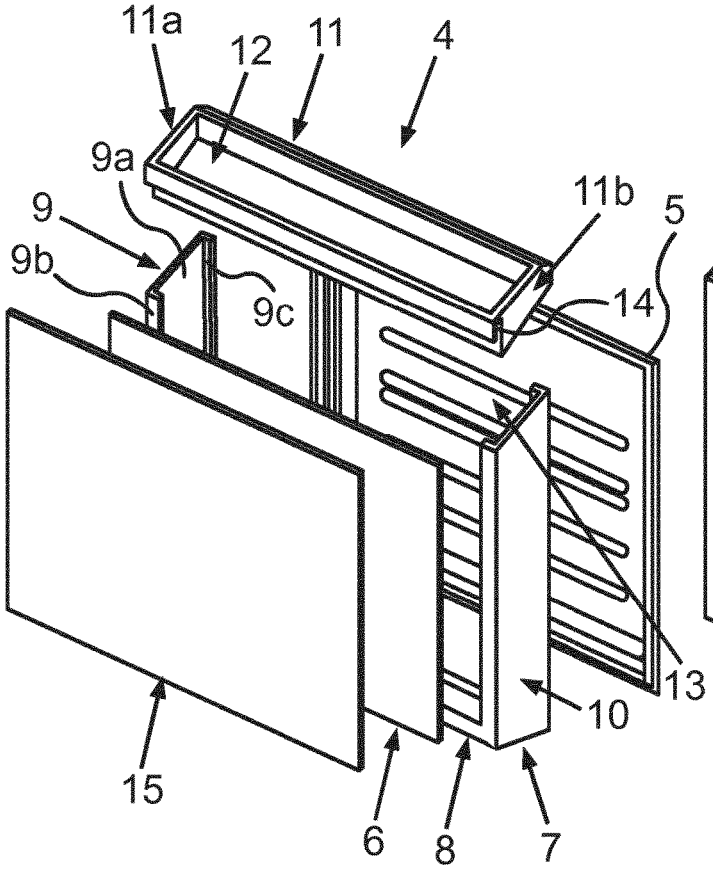
FIG. 2*a* shows an exploded view of an exemplary embodiment of an inventive door of the domestic refrigeration appliance according to FIG. 1.

FIG. 2*a* shows an exploded view of an exemplary embodiment of the door 4. The door 4 is shown compressed in respect of its height and therefore in the heightwise direction (y-direction) compared with the view in FIG. 1.

The door 4 comprises an inner door or a door inner panel 5 and a front panel or door outer panel 6, which is separate therefrom. The door 4 also comprises a door frame 7, which is configured as a single piece and with multiple sides. The door 4 here is configured as rectangular and with regard to the multiple-sided configuration of the door frame 7, this latter extends over three of these sides, in particular only over three of these sides, in the embodiment shown. Provision is also made for the door frame 7 to have a bottom side part 8 and vertical side parts 9 and 10 adjoining thereto on both sides. This configuration of the support frame 7 does not comprise a top horizontal, fourth side part. The door frame 7 is therefore configured as U-shaped in a plane spanned by the widthwise direction (x-direction) and the heightwise direction, in which the door 4 and therefore also the door frame 7 stretch or extend when the door 4 is in the closed state.

As shown, each of the side parts 8 to 10 comprises a base panel, this being explained in more detail in the following to represent the other side parts based on the vertical side part 9. Such a base panel 9*a* is therefore configured there. A tab 9*b* or 9*c* is molded on respectively as a single piece at opposing ends and therefore edges when viewed in the depthwise direction and therefore in the z-direction. These are preferably configured at an angle of 90° to the orientation of the base panel 9*a*. Therefore the side part 9 is also U-shaped in a cross-section of the side part 9 oriented through the x-z plane. The same applies to the structure and configuration of the side parts 8 and 10.

The door 4 also comprises a recessed handle element 11, which is also configured as a single piece. The recessed handle element 11 is shaped in the manner of a trough and configured as an elongated body. This recessed handle element 11 has an outwardly oriented recessed handle 12. As shown, the door frame 7 is open in the peripheral direction of the frame shape and this separate recessed handle element 11 is then positioned in an open peripheral section 13 of the door frame 7, as shown in the assembled state of the door 4 according to FIG. 2*b*. The recessed handle element 11 therefore completes the door frame 7 in respect of the closed nature of the composite component when viewed in the peripheral direction. In the embodiment according to FIGS. 2*a* and 2*b*, when viewed in this peripheral direction, the recessed handle element 11 is configured with dimensions which correspond to the dimensions of the opposing side part, specifically the side part 8.

When viewed in the peripheral direction, the recessed handle element 11 is connected to the adjoining vertical side parts 9 and 10 at opposing ends 11*a* and 11*b*. This allows a wide range of connection types to be provided, for example bonding or welding or even a plug-type connection.

Provision is made here for the recessed handle element 11 to have an engagement groove 14, in which the front tabs 9*b*, in other words those facing the door outer panel 6, and the corresponding tab of the side part 10 engage. The same provision can also be made on the opposing side of the recessed handle element 11, so that the tab 9*c* and the corresponding tab of the side part 10 can also engage here.

Provision is additionally made for the door 4 also to have a decorative panel 15, which is arranged at the front in the depthwise direction and conceals the door outer panel 6 from view.

Provision is preferably made for the door outer panel 6 to be bonded to the door frame 7, preferably also to the recessed handle element 11, it being possible for provision to be made here for bonding to the tabs 9*b* and the corresponding tabs of the further side parts 8 and 10 on their insides.

Figure 2B:
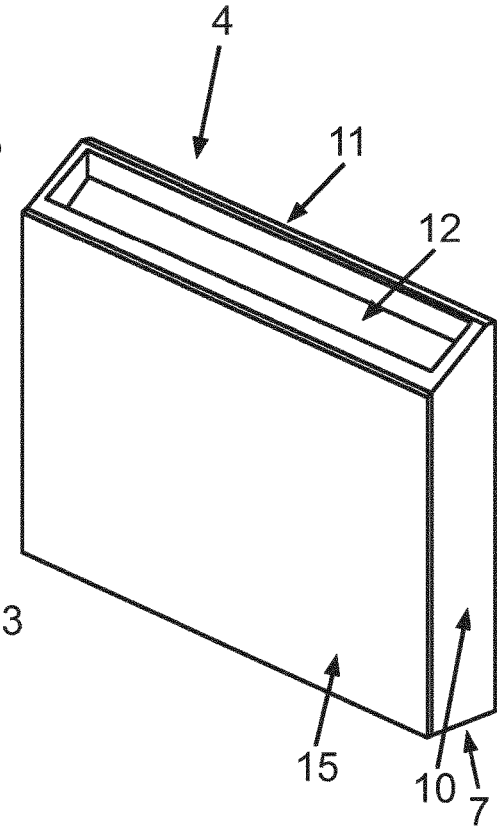
FIG. 2*b* shows the door according to FIG. 2*a* in the assembled state.

FIG. 2*b* shows the assembled state of the door 4. The process for the assembly of this door 4 is explained below according to FIG. 3. First the door frame 7 is produced as a single piece component, which is then bent at correspondingly produced bending points 7*a* and 7*b*, configured for example by shaping, thereby producing the U-shaped door frame 7 from the top left image in FIG. 3.

Figure 3:
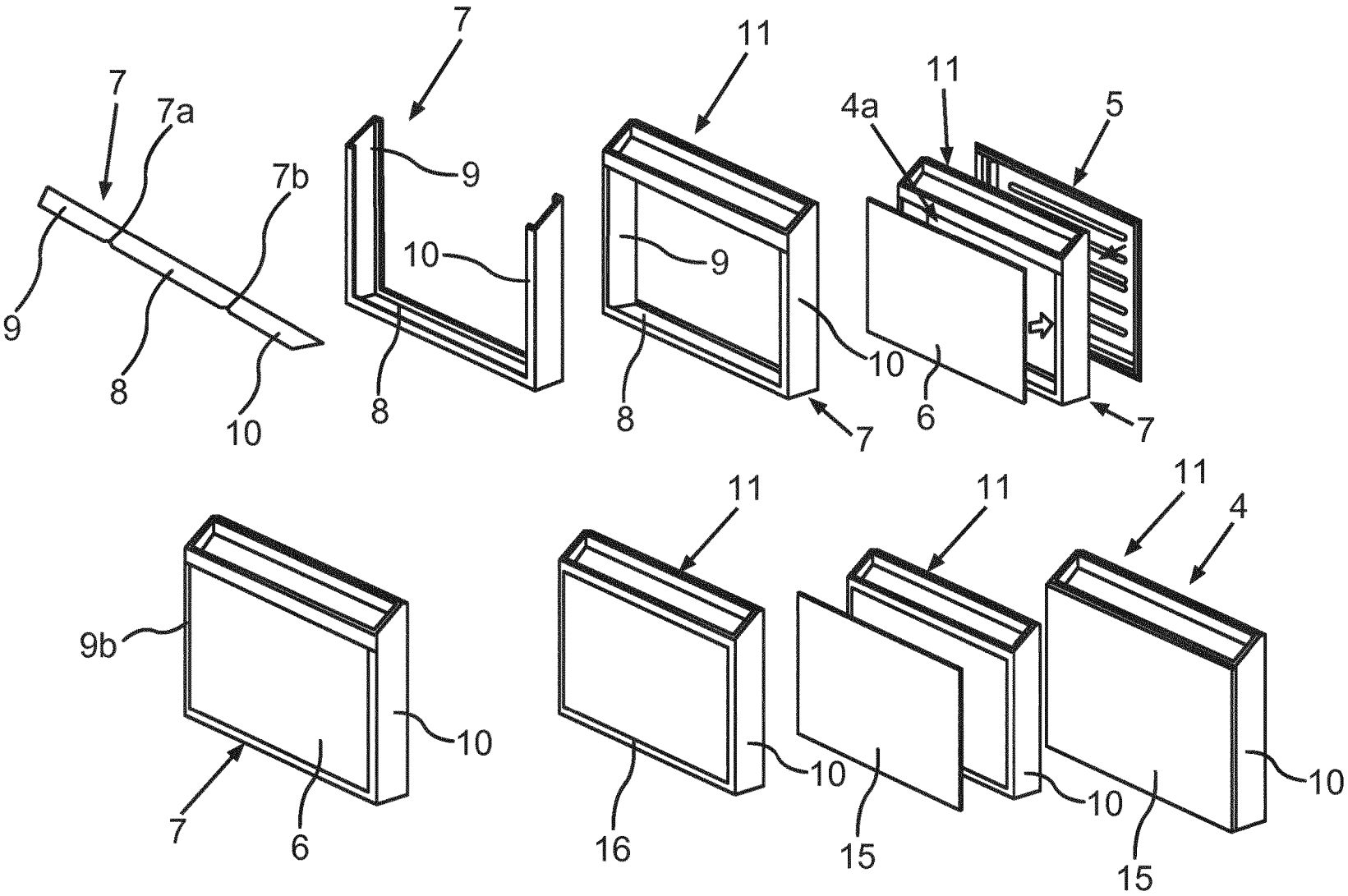
FIG. 3 shows a diagram of different assembly states of the door according to FIGS. 2*a* and 2*b;*

According to the third image in the top row in FIG. 3 the resulting separate recessed handle element 11 is then positioned and connected to the door frame.

In a subsequent assembly step the door inner panel 5 and the door outer panel 6 are connected to the door frame 7 and the recessed handle element 11, as shown in the image on the far right in the top row in FIG. 3.

The space 4*a* is then filled with the thermally insulating material, this being shown in the left-hand image in the bottom row in FIG. 3.

As also shown in this left-hand image in the bottom row in FIG. 3, the door outer panel 6 and the door inner panel 5 (not shown) face the space 4*a* and are arranged as it were within the support frame 7, so that said tabs 9*b* and 9*c* and also the corresponding tabs of the other side parts 8 and 10 engage round the outside of the door outer panel 6 and the door inner panel 5.

Then according to the diagram in FIG. 3 a bonding agent 16 is applied to the outsides of said tabs 9*b* and 9*c* facing away from the space 4*a* or of the other corresponding tabs of the side parts 8 and 10. The decorative panel 15 is then positioned thereon, as shown in the third image in the bottom row in FIG. 3. The assembled final state of the door 4, as also shown in FIG. 2*b*, is then reached in the right-hand image in the bottom row in FIG. 3.

Figure 4A:
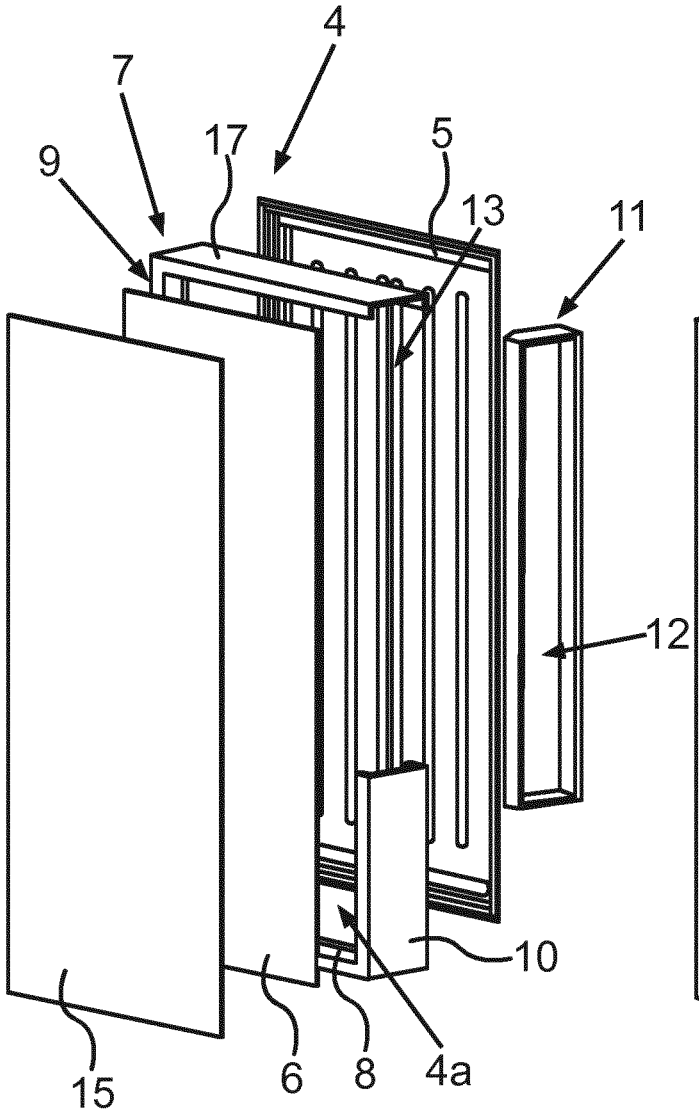
FIG. 4*a* shows an exploded view of a further exemplary embodiment of an inventive door.

FIG. 4*a* shows an exploded view of a further exemplary embodiment of a door 4. With this door provision is made for the door frame 7 to be configured not only with three sides but with four sides. However provision is made here for one vertical side part 9 to be longer than an opposing further vertical side part 10. Therefore in this embodiment the open peripheral section 13 is shorter than the side part 9. In the embodiment in FIG. 4*a* this open peripheral section 13 therefore extends over a height that is shorter than the entire height of the vertical side part 9. In this embodiment the recessed handle element 11 is then not a top door end strip but a lateral door end strip, which is arranged at the side in this open peripheral section 13. A top horizontal side part 17 of the support frame 7 is also configured here.

Figure 4B:
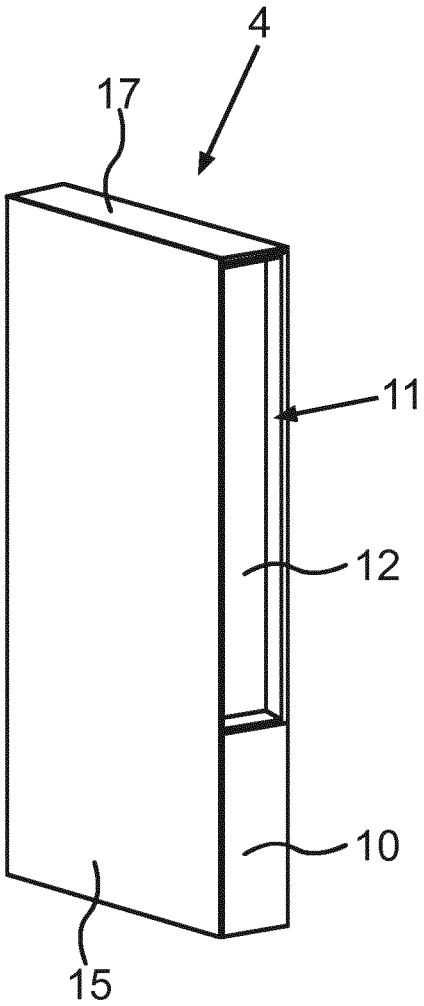
FIG. 4*b* shows the door according to FIG. 4*a* in the assembled state.

The assembly of the door 4 according to FIG. 4*a* and the assembled door 4 also shown in FIG. 4*b* is as set out in FIG. 3.

Figure 5A:
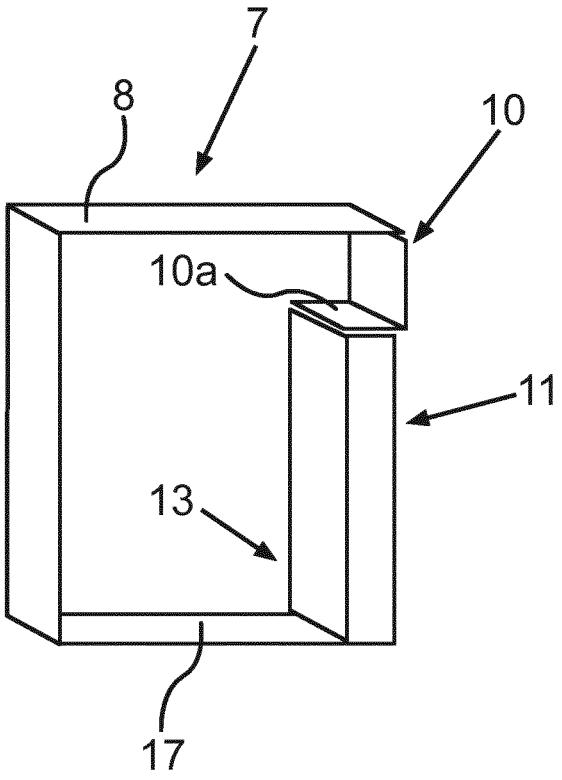
FIG. 5*a* shows a simplified schematic diagram of a further exemplary embodiment of an inventive door in subcomponents.

FIG. 5*a* shows a schematic rotated view of a further exemplary embodiment of a door frame 7 of a door 4. In this embodiment, in contrast to the view in FIG. 4*a*, the shorter vertical side part 10 is also bent horizontally and then also has a horizontal section 10*a*. The recessed handle element 11 is then connected thereto. Also in contrast to the view in FIG. 4*a* the open peripheral section 13 opens out at the bottom horizontal side part 8, while in FIGS. 4*a* and 4*b* it opens out at the top horizontal side part 17.

Figure 5B:
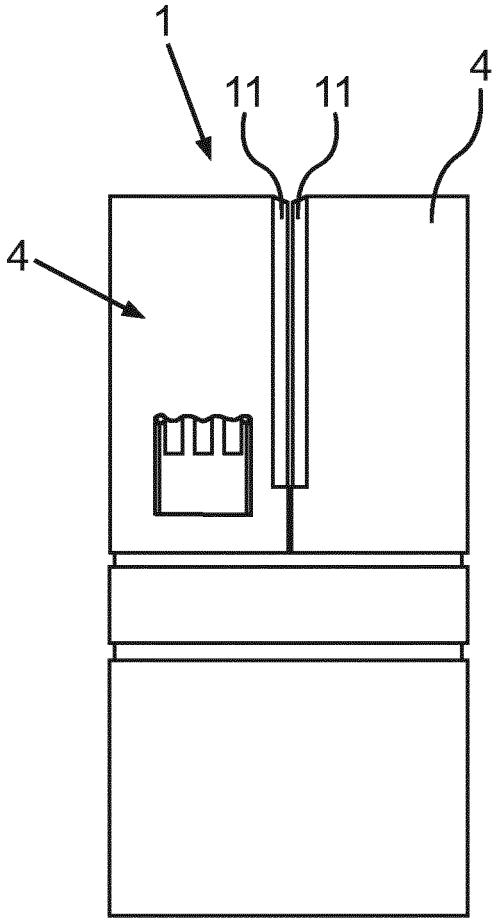
FIG. 5*b* shows a front view of a further exemplary embodiment of a domestic refrigeration appliance with a door, which comprises the components according to FIG. 5*a*.

FIG. 5*b* shows a simplified front view of a further exemplary embodiment of a domestic refrigeration appliance 1. Provision is made here for two doors 4 to be arranged adjacent to one another, each being configured individually to close a separate chamber. Components of such a door 4, as shown in FIG. 5*a*, are implemented there. The recessed handle elements 11 are then configured to face one another and the component arrangement according to FIG. 5*a* is also displaced through 180° compared with the view in FIG. 5*a* in FIG. 5*b*. This means that the recessed handle element 11 opens out in the direction of the top edge of the door 4 and the shorter vertical side part 10 then as it were adjoins the bottom edge or the bottom side part 8.

LIST OF REFERENCE CHARACTERS

1 Domestic refrigeration appliance
2 Housing
3 Chamber
4 Door
4*a* Space
5 Door inner panel
6 Door outer panel
7 Door frame
8 Bottom side part
9 Vertical side part
9*a* Base panel
9*b* Tab
9*c* Tab
10 Vertical side part
11 Recessed handle element
12 Recessed handle
13 Peripheral section
14 Engagement groove
15 Decorative panel
16 Bonding agent
17 Side part

The invention claimed is:

1. A door for a domestic refrigeration appliance, comprising:

a multiple-sided door frame having at least three sides integrally formed of a single-piece profile defining a periphery of said door frame, said door frame being open in a peripheral direction of a frame shape with an open peripheral section where two opposite sides of said at least three sides do not contact one another;

a door inner panel and a door outer panel mounted to said door frame;

a separate recessed handle element arranged in said open peripheral section of said door frame, said recessed handle element extended over an entire width of said open peripheral section, as viewed in the peripheral direction, the width being smaller than a width of a side part of said door frame opposite said open peripheral section; and a thermally insulating material disposed in a space between said door outer panel and said door inner panel;

said recessed handle element extending from said door outer panel to said door inner panel.

2. The door according to claim 1, wherein said recessed handle element has opposing ends as viewed in a peripheral direction of the frame shape; and said opposing ends of said recessed handle element are connected to said door frame.

3. The door according to claim 2, wherein said recessed handle element is bonded or welded to said door frame.

4. The door according to claim 2, wherein said recessed handle element is screwed to said door frame or connected to said door frame by way of a plug connection.

5. The door according to claim 1, wherein said recessed handle element is a trough-shaped element.

6. The door according to claim 1, wherein said recessed handle element is formed as a single piece.

7. The door according to claim 1, wherein said open peripheral section is formed at the top and the recessed handle element is disposed in the peripheral section as a top door end strip.

8. The door according to claim 1, wherein said open peripheral section is formed in a vertical side of said door frame and said recessed handle element is disposed in the peripheral section as a lateral door end strip.

9. The door according to claim 1, wherein at least some of said at least three sides include: tabs with an inside of said door outer panel arranged thereon, and tabs with an inside of said door inner panel arranged thereon.

10. The door according to claim 1, comprising a decorative panel, being separate from said door outer panel, disposed on an outside of said door outer panel facing away from said door frame.

11. A domestic refrigeration appliance, comprising a housing forming a chamber for holding food and a door according to claim 1 mounted to said housing and configured for closing said chamber.

12. The door according to claim 1, wherein said single profile is a profile selected from the group consisting of a bent profile, an extruded profile and a rolled profile.

* * * * *